US006742855B2

(12) United States Patent
Whitaker et al.

(10) Patent No.: US 6,742,855 B2
(45) Date of Patent: Jun. 1, 2004

(54) FREEZER TIP OUT BIN

(75) Inventors: Carl Tobert Whitaker, LaGrange, KY (US); Rakesh Mathur, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/997,921

(22) Filed: Nov. 30, 2001

(65) Prior Publication Data

US 2003/0102787 A1 Jun. 5, 2003

(51) Int. Cl.[7] ..... A47B 96/16
(52) U.S. Cl. ..... 312/405.1; 312/321.5
(58) Field of Search ..... 312/404, 405.1, 312/327, 328, 321.5, 298, 248; 211/90.02, 150; 248/185.1, 291.1, 240, 240.1

(56) References Cited

U.S. PATENT DOCUMENTS

| | | | | | |
|---|---|---|---|---|---|
| 289,378 | A | * | 12/1883 | Saunders et al. | 34/281 |
| 1,560,967 | A | | 11/1925 | Bowlus | |
| 2,155,967 | A | * | 4/1939 | Carroll | 312/405.1 |
| 2,380,005 | A | | 7/1945 | Wilson | |
| 2,441,376 | A | | 5/1948 | Stiening | |
| 2,693,989 | A | | 11/1954 | Santana et al. | |
| 2,694,906 | A | * | 11/1954 | Didion | 62/326 |
| 2,823,972 | A | * | 2/1958 | Saunders | 312/311 |
| 2,898,173 | A | * | 8/1959 | Squire | 312/248 |
| 3,797,272 | A | | 3/1974 | Huey | |
| 4,132,458 | A | | 1/1979 | Leek | |
| 4,186,978 | A | * | 2/1980 | Thomson | 312/321.5 |
| 5,346,299 | A | * | 9/1994 | Werkmeister et al. | 312/405.1 |
| 5,599,081 | A | * | 2/1997 | Revlett et al. | 312/406 |
| 5,758,512 | A | | 6/1998 | Peterson et al. | |
| 5,899,083 | A | | 5/1999 | Peterson et al. | |

FOREIGN PATENT DOCUMENTS

| | | | | |
|---|---|---|---|---|
| BE | 534751 | * | 10/1958 | 312/321.5 |

* cited by examiner

*Primary Examiner*—Janet M. Wilkens
(74) *Attorney, Agent, or Firm*—H. Neil Houser, Esq; Armstrong Teasdale LLP

(57) ABSTRACT

A freezer tip out bin includes a stationary portion, a rotating portion pivotally coupled to the stationary portion, and a biased actuator coupled to the rotating portion.

18 Claims, 3 Drawing Sheets

FREEZER TIP OUT BIN

BACKGROUND OF THE INVENTION

This invention relates generally to tip out bins, and, more specifically, to a tip out bin for a freezer.

Known refrigerators include a cabinet housing including an outer case and one or more inner liners therein that defines a fresh food compartment and a freezer compartment. The fresh food compartment and freezer compartments are closed by separate access doors hingedly attached to the case. A number of storage shelves, baskets, and drawers are employed in the fresh food compartment to organize food. See, for example, U.S. Pat. No. 5,729,997. One such food storage feature is commonly known as a freezer tip out bin that is intended to store frozen foods therein. Conventional freezer tip out bins are, however, disadvantaged in several respects.

For example, some tip out bins are relatively difficult to tip out. Further, due to efforts to facilitate tipping out a bin, some tip out bins tip out too easily causing freezer owners to constantly close an accidentally tipped out bin.

BRIEF DESCRIPTION OF THE INVENTION

In one aspect, a freezer tip out bin is provided. The freezer tip out bin includes a stationary portion, a rotating portion pivotally coupled to the stationary portion, and a biased actuator coupled to the rotating portion.

In another aspect, a freezer tip out bin includes a stationary portion including an opening positioned in a raised portion of the stationary portion, the raised portion having a substantially elongated oval shape and a substantially arcuate cross-section. The freezer tip out bin also includes a rotating portion pivotally coupled to the stationary portion; the rotating portion includes at least one sidewall including a cavity unitary with a side wall support member extending out from an inner wall of the sidewall and down from an upper surface of the sidewall. The freezer tip out also includes a biased actuator coupled to the sidewall and positioned in the cavity, and the opening is sized to receive the biased actuator.

In still another aspect, a refrigerator is provided. The refrigerator includes a fresh food portion, a freezer portion proximate the fresh food portion, a door pivotally mounted to the freezer portion, and a tip out bin mounted to the door. The tip out bin includes a stationary portion, a rotating portion pivotally coupled to the stationary portion, and biased actuator coupled to the rotating portion.

DETAILED DESCRIPTION OF THE INVENTION

Figure 1:
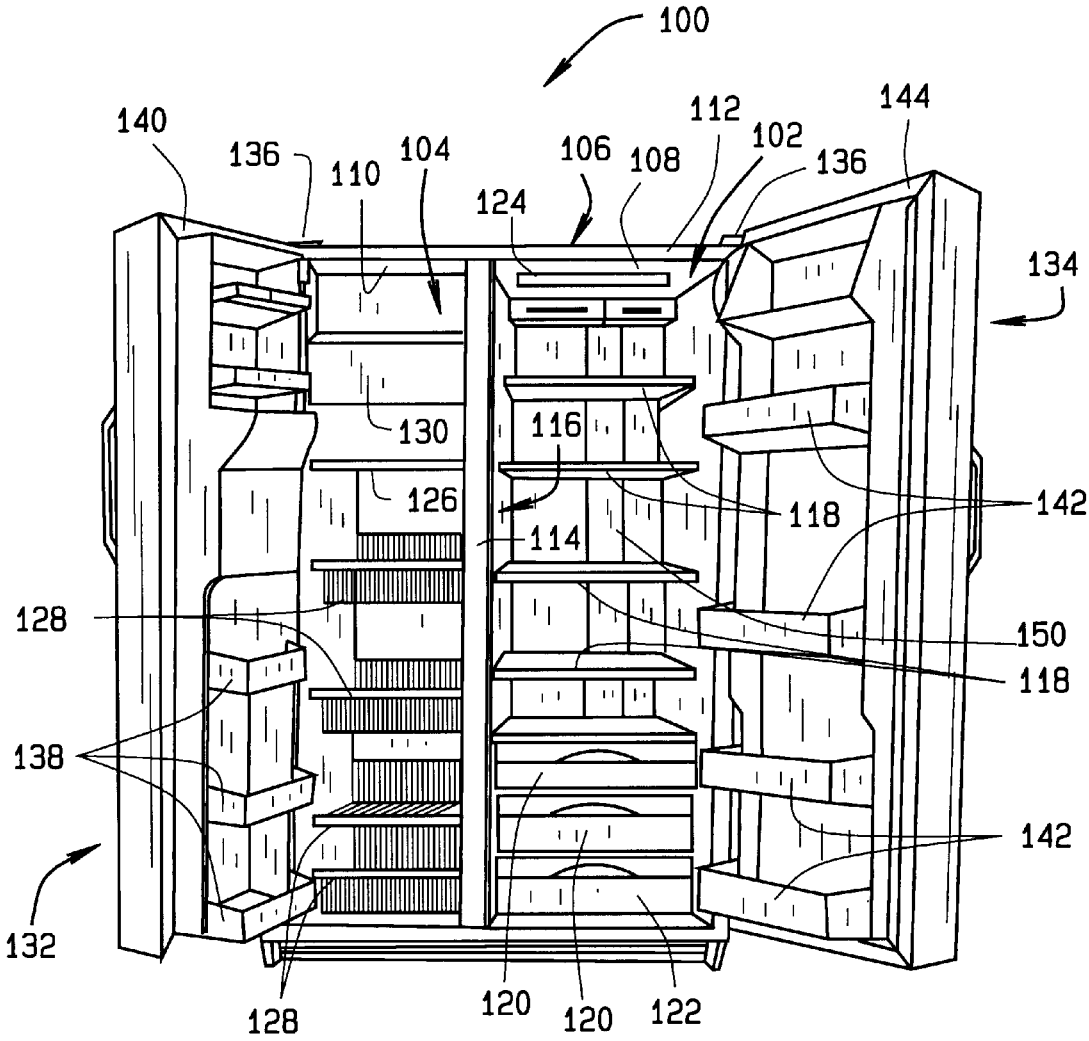
FIG. 1 is a perspective view of an exemplary refrigerator.

FIG. 1 illustrates an exemplary refrigeration appliance 100 in which the present invention may be practiced. In the embodiment described and illustrated herein, appliance 100 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side within an outer case 106 and defined by inner liners 108 and 110 therein. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out storage drawers 120, sometimes referred to as storage pans, normally are provided in fresh food compartment 102 to support items being stored therein. A bottom drawer or pan 122 is commonly referred to as a crisper drawer and is intended for storage of fruit and vegetables. It is understood, however, that the present invention may be employed in any of storage pans 120 in addition to, or in lieu of, pan 122.

Refrigerator 100 is controlled by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes at least one tip out bin 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown ) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
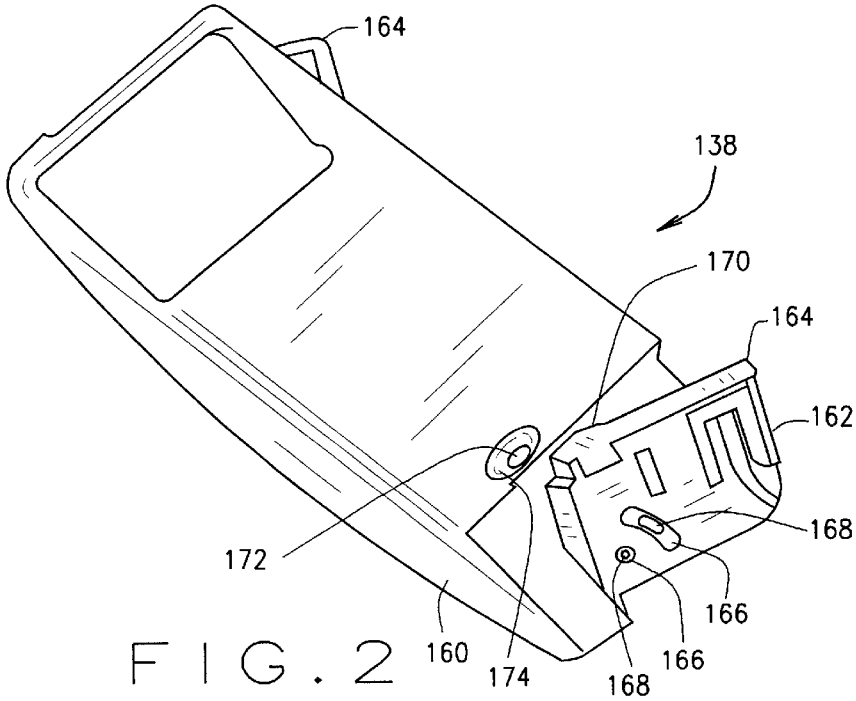
FIG. 2 is a perspective view of a tip out bin shown in FIG. 1.
Figure 3:
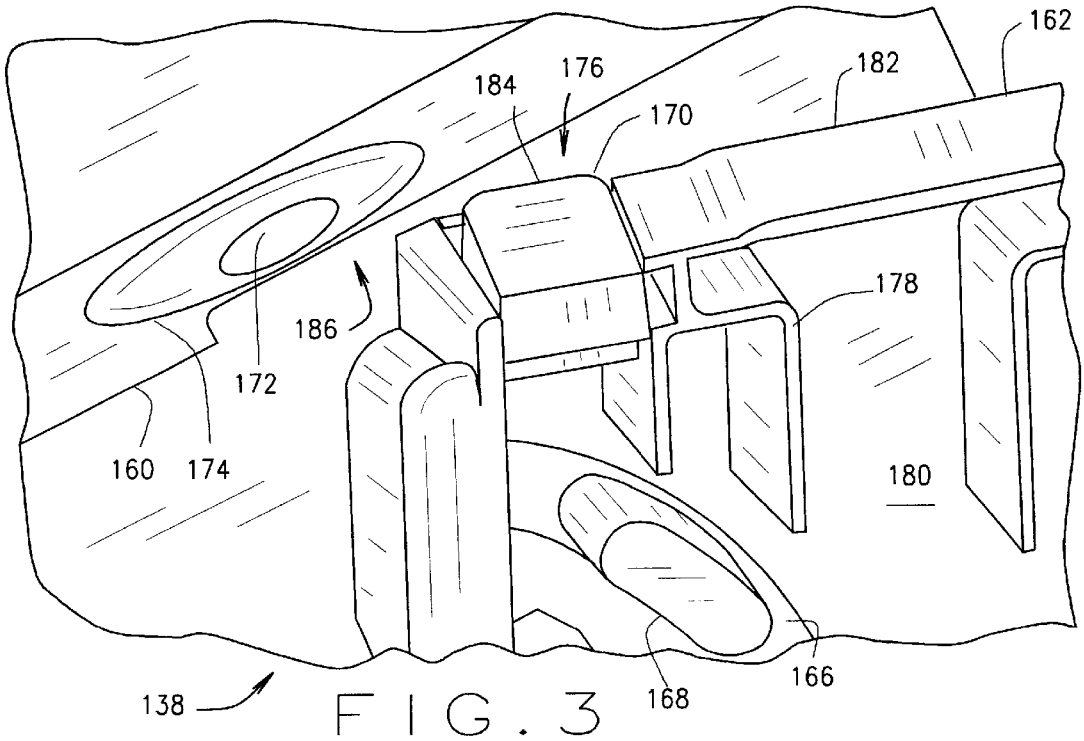
FIG. 3 is a close up perspective view of the tip out bin shown in FIG. 1.

FIG. 2 is a perspective view of tip out bin 138 (shown in FIG. 1), and FIG. 3 is a close up perspective view of tip out bin 138 (shown in FIG. 1). Tip out bin 138 includes a rotating portion 160 and a stationary portion 162 pivotally coupled to rotating portion 160. More particularly, stationary portion 162 includes two generally opposed sidewalls 164 including a plurality of arcuate openings 166 sized to at least partially receive a plurality of guide members 168 extending from stationary portion 160. In an exemplary embodiment, at least one guide member 168 is elongated and at least one guide member 168 is substantially circular. In an alternative embodiment, stationary portion 162 includes only one arcuate opening 166. Stationary portion 162 also includes a biased actuator 170 coupled to at least one sidewall 164. Rotating portion 160 includes an opening 172 sized to receive at least a portion of biased actuator 170. In an exemplary embodiment, opening 172 is positioned in a raised portion 174 that has a substantially elongate oval shape and substantially arcuate cross-section (not shown). In one embodiment, the cross-section is substantially a half circle. Biased actuator 170 is positioned in a cavity 176 integral with a side wall support member 178 that extends outwardly from an inner wall 180 of sidewall 164 and outwardly from an upper surface 182 of sidewall 164. In another embodiment, cavity 176 is unitary with a side wall support member 178.

In use, rotating portion 160 is positionable in a closed position and a tilted out position. For example, to position rotating portion 160 in the closed position, rotating portion 160 is rotated toward stationary portion 162, and biased actuator 170 engages raised portion 174 which facilitates alignment between opening 172 and biased actuator 170. Biased actuator 170 extends through opening 172 and provides a positive lock such that rotating portion rotating portion 160 is held 160 substantially against stationary portion 162. Biased actuator 170 is depressed to released rotating portion 160 from the positive lock such that rotating portion 160 can rotate or pivot away from stationary portion 162 allowing a user enhanced access for placing food in, or removing food from, tip out bin 138. In other words, biased actuator 170 is depressible such that a top surface 184 of biased actuator 170 can pass beneath a bottom surface 186 of rotating portion 160, thus allowing rotating portion 160 to rotate or pivot away from stationary portion 162.

Figure 4:
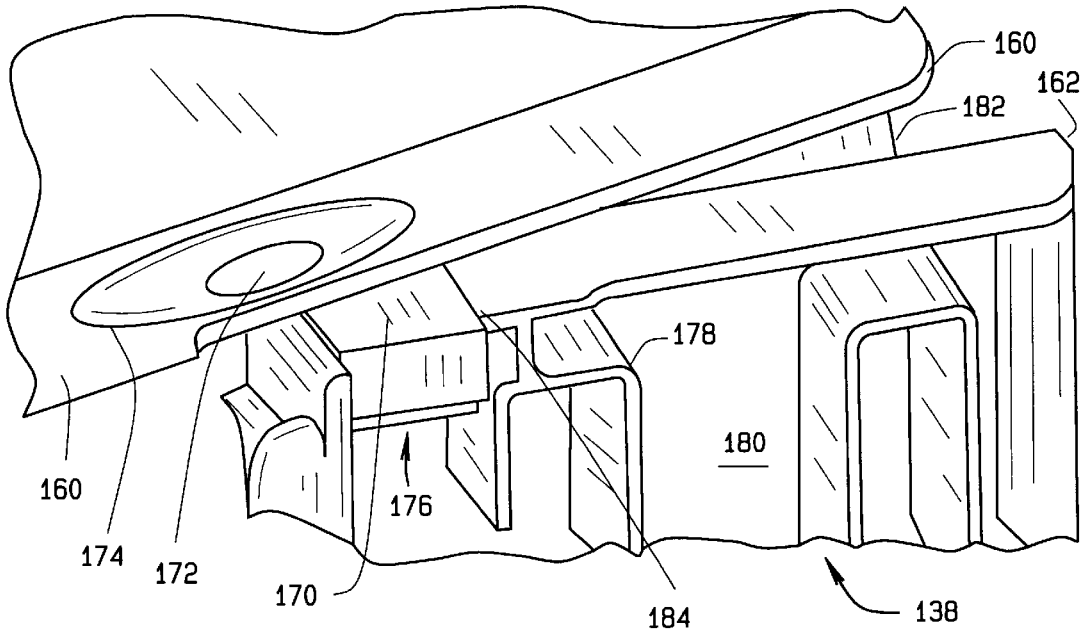
FIG. 4 is a close up perspective view of the tip out bin shown in FIG. 1 with a biased actuator depressed.
Figure 5:
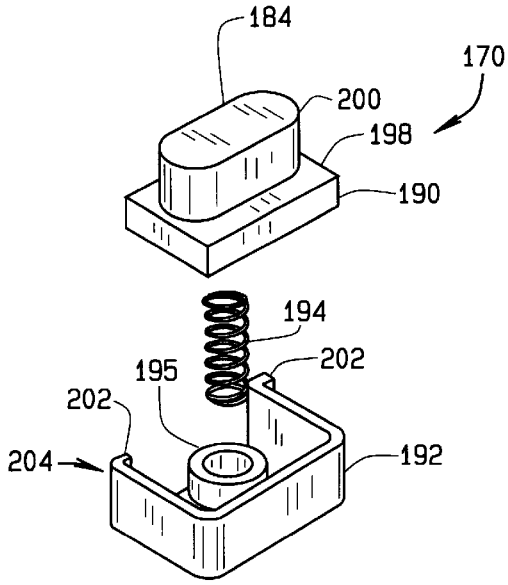
FIG. 5 is an exploded perspective view of the biased actuator shown in FIG. 4.

FIG. 4 is a close up perspective view of tip out bin 138 (shown in FIG. 1) with biased actuator 170 depressed, and FIG. 5 is an exploded perspective view of biased actuator 170. Biased actuator 170 includes a top portion 190 and a bottom portion 192 which is coupled to top portion 190 and biased from top portion 190 by a biasing member 194. In an exemplary embodiment, biasing member 194 is a spring and is positioned in a substantially circular cavity 196. Top portion 190 has a substantially rectangular base part 198 and a substantially oval depressible portion 200. Bottom portion 192 includes a plurality of mounting tabs 202 extending from an open side 204. Mounting tabs 202 are used to mount biased actuator 170 in cavity 176 (shown in FIG. 4).

While the invention has been described in terms of various specific embodiments, those skilled in the art will recognize that the invention can be practiced with modification within the spirit and scope of the claims.

What is claimed is:

1. A freezer tip out bin comprising:

a stationary portion;

a rotating portion pivotally coupled to said stationary portion; and a biased actuator coupled to said stationary portion, said rotating portion comprising an opening sized to receive at least a portion of said biased actuator.

2. A bin in accordance with claim 1 wherein said stationary portion comprises at least one sidewall, said biased actuator coupled to said sidewall.

3. A bin in accordance with claim 1 wherein said stationary portion comprises at least one sidewall comprising a cavity, said biased actuator coupled to said sidewall within said cavity.

4. A bin in accordance with claim 1 wherein said stationary portion comprises at least one sidewall comprising a cavity integral with a side wall support member, said biased actuator coupled to said sidewall within said cavity.

5. A bin in accordance with claim 1 wherein said stationary portion comprises at least one sidewall comprising a cavity unitary with a side wall support member, said biased actuator coupled to said sidewall within said cavity.

6. A freezer tip out bin comprising:

a stationary portion:

a rotating portion pivotally coupled to said stationary portion; and a biased actuator coupled to said stationary portion, and wherein said stationary portion comprises at least one sidewall comprising a cavity unitary with a side wall support member extending outwardly from an inner wall of said sidewall and outwardly from an upper surface of said sidewall, said biased actuator coupled to said sidewall within said cavity.

7. A freezer tip out bin comprising:

a stationary portion:

a rotating portion pivotally coupled to said stationary portion; and a biased actuator coupled to said stationary portion, and wherein said biased actuator comprises a top portion comprising a substantially rectangular base part and a substantially oval portion.

8. A bin in accordance with claim 7 wherein said biased actuator is depressible and further comprises a bottom portion comprising a plurality of mounting tabs extending from said bottom portion.

9. A freezer tip out bin comprising:

a stationary portion;

a rotating portion pivotally coupled to said stationary portion; and a biased actuator coupled to said stationary portion, and wherein said rotating portion comprises an opening sized to receive at least a portion of said biased actuator, said opening is positioned in a raised portion of said rotating portion.

10. A freezer tip out bin comprising:

a stationary portion;

a rotating portion pivotally coupled to said stationary portion; and a biased actuator coupled to said stationary portion, and wherein said rotating portion comprises an opening sized to receive at least a portion of said biased actuator, said opening is positioned in a raised portion of said rotating portion, said raised portion has a substantially elongated oval shape and a substantially arcuate cross-section.

11. A freezer tip out bin comprising:

a rotating portion comprising an opening positioned in a raised portion of said rotating portion, said raised portion having a substantially elongated oval shape and a substantially arcuate cross-section;

a stationary portion pivotally coupled to said rotating portion, said stationary portion comprises at least one sidewall comprising a cavity unitary with a side wall support member extending outwardly from an inner wall of said sidewall and outwardly from an upper surface of said sidewall; and a biased actuator coupled to said sidewall within said cavity, said opening sized to receive at least a portion of said biased actuator.

12. A refrigerator comprising:

a fresh food portion;

a freezer portion proximate said fresh food portion;

a door pivotally mounted to said freezer portion; and a tip out bin mounted to said door, said tip out bin comprising:

a stationary portion;

a rotating portion pivotally coupled to said stationary portion; and a biased actuator coupled to said stationary portion, said rotating portion comprising an opening sized to receive at least a portion of said biased actuator.

13. A refrigerator in accordance with claim 12 wherein said stationary portion comprises at least one sidewall comprising a cavity, said biased actuator coupled to said sidewall within said cavity.

14. A refrigerator in accordance with claim 12 wherein said stationary portion comprises at least one sidewall comprising a cavity unitary with a side wall support member, said biased actuator coupled to said sidewall within said cavity.

15. A refrigerator in accordance with claim 12 wherein said stationary portion comprises at least one sidewall comprising a cavity unitary with a side wall support member extending out from an inner wall of said sidewall and down from an upper surface of said sidewall, said biased actuator coupled to said sidewall and positioned in said cavity.

16. A refrigerator comprising:

a fresh food portion:

a freezer portion proximate said fresh food portion;

a door pivotally mounted to said freezer portion; and a tip out bin mounted to said door, said tip out bin comprising:

a stationary portion;

a rotating portion pivotally coupled to said stationary portion; and a biased actuator coupled to said stationary portion, and wherein said biased actuator comprises a top portion comprising a substantially rectangular base part and a substantially oval depressible portion.

17. A refrigerator in accordance with claim 16 wherein said biased actuator further comprises a bottom portion comprising a plurality of mounting tabs extending from an open side of said bottom portion.

18. A refrigerator comprising:

a fresh food portion;

a freezer portion proximate said fresh food portion;

a door pivotally mounted to said freezer portion; and a tip out bin mounted to said door, said tip out bin comprising:

a stationary portion;

a rotating portion pivotally coupled to said stationary portion; and a biased actuator coupled to said stationary portion, and wherein said rotating portion comprises an opening sized to receive at least a portion of said biased actuator, said opening is positioned in a raised portion of said rotating portion, said raised portion has a substantially elongated oval shape and a substantially arcuate cross-section.

* * * * *